US008042918B2

(12) United States Patent
Hayashi

(10) Patent No.: US 8,042,918 B2
(45) Date of Patent: Oct. 25, 2011

(54) LIQUID DISCHARGING HEAD AND IMAGE FORMING APPARATUS INCLUDING THE LIQUID DISCHARGING HEAD

(75) Inventor: Keisuke Hayashi, Ebina (JP)

(73) Assignee: Ricoh Company, Ltd., Tokyo (JP)

( * ) Notice: Subject to any disclaimer, the term of this patent is extended or adjusted under 35 U.S.C. 154(b) by 329 days.

(21) Appl. No.: 12/128,945

(22) Filed: May 29, 2008

(65) Prior Publication Data

US 2009/0002460 A1 Jan. 1, 2009

(30) Foreign Application Priority Data

Jun. 28, 2007 (JP) ..... 2007-170803

(51) Int. Cl.
*B41J 2/045* (2006.01)

(52) U.S. Cl. ..... 347/70; 347/68; 347/72

(58) Field of Classification Search ..... 347/68–72
See application file for complete search history.

(56) References Cited

U.S. PATENT DOCUMENTS

| | | | | |
|---|---|---|---|---|
| 5,907,340 | A * | 5/1999 | Katakura et al. | 347/71 |
| 2002/0017142 | A1 * | 2/2002 | Kitahara | 73/662 |
| 2007/0291084 | A1 | 12/2007 | Hayashi | |

FOREIGN PATENT DOCUMENTS

| | | |
|---|---|---|
| JP | 8-118642 | 5/1996 |
| JP | 8-127126 | 5/1996 |
| JP | 8-142325 | 6/1996 |
| JP | 10-157148 | 6/1998 |
| JP | 2003-266711 | 9/2003 |
| JP | 2006-175845 | 7/2006 |

* cited by examiner

*Primary Examiner* — Geoffrey Mruk

(74) *Attorney, Agent, or Firm* — Cooper & Dunham LLP

(57) ABSTRACT

A liquid discharging head includes a piezoelectric actuator configured to displace a vibration plate to cause a nozzle to discharge a liquid drop from a liquid chamber. The piezoelectric actuator includes at least three piezoelectric elements aligned in a line. Each of the at least three piezoelectric elements includes a plurality of piezoelectric element columns and a groove. The plurality of piezoelectric element columns is aligned in a direction in which the at least three piezoelectric elements are aligned. The groove is provided between adjacent piezoelectric element columns. At least one of the at least three piezoelectric elements has a pitch between adjacent piezoelectric element columns that is different from a pitch between adjacent piezoelectric element columns of at least one other piezoelectric element of the at least three piezoelectric elements.

11 Claims, 9 Drawing Sheets

LIQUID DISCHARGING HEAD AND IMAGE FORMING APPARATUS INCLUDING THE LIQUID DISCHARGING HEAD

BACKGROUND

1. Technical Field

The present specification describes a liquid discharging head and an image forming apparatus, and more particularly, a liquid discharging head and an image forming apparatus including the liquid discharging head for discharging liquid onto a recording medium to form an image on the recording medium.

2. Discussion of the Background

An image forming apparatus, such as a copier, a printer, a facsimile machine, a plotter, or a multifunction printer having at least one of copying, printing, scanning, and facsimile functions, typically forms an image on a recording medium (e.g., a sheet) by a liquid discharging method. Thus, for example, a liquid discharging head (e.g., a recording head) included in a liquid discharging device discharges liquid (e.g., an ink drop) onto a conveyed sheet, and the liquid is then adhered to the sheet to form an image on the sheet.

Currently, there is market demand for an image forming apparatus capable of forming an image at high speed. To accommodate such demand, the liquid discharging head may either discharge liquid at a higher rate or may include more nozzles. However, to stably discharge liquid at a higher rate, a carriage on which the liquid discharging head is mounted needs to move at high speed. Accordingly, a powerful motor for driving the carriage that needs to be controlled precisely and a long liquid discharging head having more nozzles are needed.

One example of such long liquid discharging head includes a piezoelectric actuator including a plurality of piezoelectric elements arranged on a base. In each of the plurality of piezoelectric elements, a plurality of piezoelectric element columns is arranged in such a manner that a groove is provided between adjacent piezoelectric element columns.

Generally, a dicing blade may be used to form such grooves in the piezoelectric elements adhered to the base in such a manner that a particular clearance is provided between the adjacent piezoelectric elements. However, when a center of the dicing blade does not correspond to a center of the clearance, for example, when the center of the dicing blade is substantially shifted from the center of the clearance, the dicing blade may be obliquely inserted into the clearance, degrading processing quality of the clearance and consequently imparting instability to the drive provided by the piezoelectric element columns.

To address this problem, a width of the clearance between the adjacent piezoelectric elements may be made equal to a width of the dicing blade so as not to form the groove in the clearance. Alternatively, widths of the plurality of piezoelectric elements may be identical and widths of the clearances may also be identical. In this case, the piezoelectric elements need to be manufactured and arranged on the base with high precision. However, as a practical matter such high manufacturing precision is difficult to achieve.

Obviously, such degraded processing quality of the clearance and unstable drive performance of the piezoelectric element columns are undesirable, and accordingly, there is a need for a technology to prevent such degraded processing quality of the clearance and such unstable drive performance of the piezoelectric element columns, even when the piezoelectric elements and the clearances are not manufactured and arranged with the desired high dimensional precision.

BRIEF SUMMARY

In an aspect of this disclosure, there is provided a novel liquid discharging head for discharging a liquid drop from a nozzle connected to a liquid chamber including a wall formed of a vibration plate. In one example, such a novel liquid discharging head includes a piezoelectric actuator configured to displace the vibration plate to cause the nozzle to discharge the liquid drop from the liquid chamber. The piezoelectric actuator includes at least three piezoelectric elements aligned in a line. Each piezoelectric element of the at least three piezoelectric elements includes a plurality of piezoelectric element columns and a groove. The plurality of piezoelectric element columns is aligned in a direction in which the at least three piezoelectric elements are aligned. The groove is provided between adjacent piezoelectric element columns. At least one of the at least three piezoelectric elements has a pitch between adjacent piezoelectric element columns that is different from a pitch between adjacent piezoelectric element columns of at least one other piezoelectric element of the at least three piezoelectric elements.

In another aspect of this disclosure, there is provided a novel image forming apparatus for forming an image. In one example, such a novel image forming apparatus includes a liquid discharging head configured to discharge a liquid drop from a nozzle connected to a liquid chamber including a wall formed of a vibration plate. The liquid discharging head includes a piezoelectric actuator configured to displace the vibration plate to cause the nozzle to discharge the liquid drop from the liquid chamber. The piezoelectric actuator includes at least three piezoelectric elements aligned in a line. Each piezoelectric element of the at least three piezoelectric elements includes a plurality of piezoelectric element columns and a groove. The plurality of piezoelectric element columns is aligned in a direction in which the at least three piezoelectric elements are aligned. The groove is provided between adjacent piezoelectric element columns. At least one of the at least three piezoelectric elements has a pitch between adjacent piezoelectric element columns that is different from a pitch between adjacent piezoelectric element columns of at least one other piezoelectric element of the at least three piezoelectric elements.

BRIEF DESCRIPTION OF THE DRAWINGS

A more complete appreciation of the disclosure and many of the attendant aforementioned and other aspects, features and advantages devices, apparatuses and techniques therein will be readily obtained as the same becomes better understood by reference to the following detailed description when considered in connection with the accompanying drawings, wherein.

DETAILED DESCRIPTION OF THE EXEMPLARY EMBODIMENTS

Figure 1:
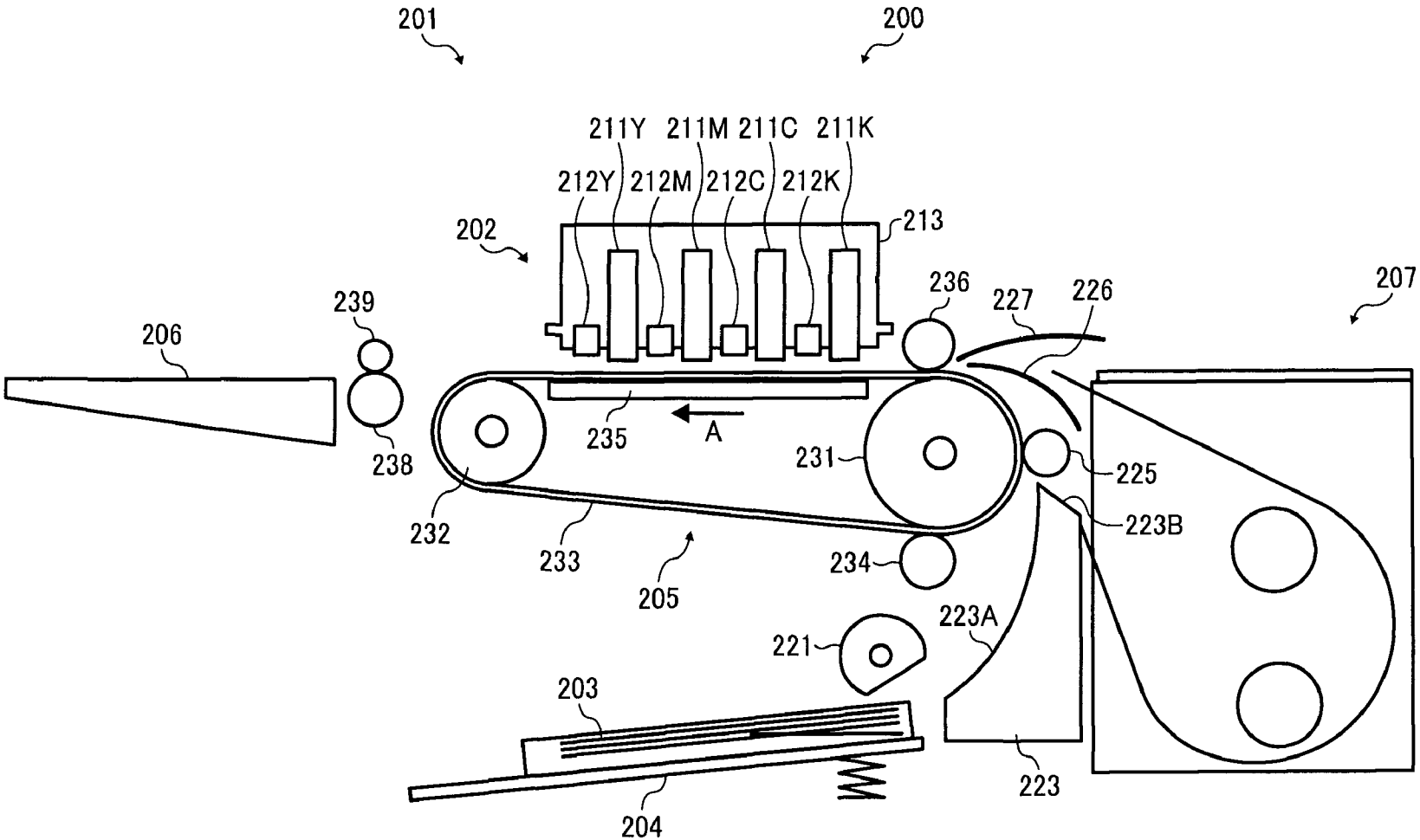
FIG. 1 is a schematic view of an image forming apparatus according to an exemplary embodiment.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 200 according to an exemplary embodiment is explained.

As illustrated in FIG. 1, the image forming apparatus 200 includes a paper tray 204, a body 201, an output tray 206, and a duplex unit 207. The body 201 includes a convey mechanism 205, an image forming device 202, a feed roller 221, a convey guide 223, a registration roller 225, guides 226 and 227, an output roller 238, and a spur 239. The convey mechanism 205 includes a convey belt 233, a convey roller 231, a driven roller 232, a charging roller 234, a platen 235, and a pressing roller 236. The image forming device 202 includes recording heads 211K, 211C, 211M, and 211Y, a head holder 213, and maintenance-recovery mechanisms 212K, 212C, 212M, and 212Y. The convey guide 223 includes guide surfaces 223A and 223B.

The image forming apparatus 200 can be any of a copier, a printer, a facsimile machine, a plotter, and a multifunction printer including at least one of copying, printing, scanning, plotter, and facsimile functions. In this non-limiting exemplary embodiment, the image forming apparatus 200 functions as a printer for forming an image on a recording medium.

The paper tray 204 is provided below the body 201 and loads a recording medium (e.g., a plurality of sheets 203), which is not limited to paper. The convey mechanism 205 and the image forming device 202 are provided in the body 201. The convey mechanism 205 receives and conveys a sheet 203 sent from the paper tray 204. While the convey mechanism 205 conveys the sheet 203, the image forming device 202, serving as a liquid discharging device, forms an image on the sheet 203. The output tray 206 is attached to a side of the body 201 and receives the sheet 203 bearing the image sent from the body 201.

The duplex unit 207 is attachable and detachable to and from the body 201. To form an image on both sides of a sheet 203, after an image is formed on one side (e.g., a front side) of the sheet 203, the convey mechanism 205 feeds the sheet 203 backward toward the duplex unit 207. The guide 227 guides the sheet 203 fed by the convey mechanism 205 toward the duplex unit 207. The duplex unit 207 reverses the sheet 203 and sends the sheet 203 toward the convey mechanism 205, so that an image is formed on another side (e.g., a back side) of the sheet 203. The guide surface 223B of the convey guide 223 guides the sheet 203 sent from the duplex unit 207 toward the convey mechanism 205. After the image forming device 202 forms an image on the back side of the sheet 203, the sheet 203 is output onto the output tray 206.

The recording heads 211K, 211C, 211M, and 211Y serve as four line-type liquid discharging heads for discharging black, cyan, magenta, and yellow liquids (e.g., a liquid drop or an ink drop), respectively. The head holder 213 holds the recording heads 211K, 211C, 211M, and 211Y in a state that nozzle surfaces of nozzles of the recording heads 211K, 211C, 211M, and 211Y face down to discharge black, cyan, magenta, and yellow liquids, respectively.

The maintenance-recovery mechanisms 212K, 212C, 212M, and 212Y correspond to the recording heads 211K, 211C, 211M, and 211Y to maintain and recover performance of the recording heads 211K, 211C, 211M, and 211Y, respectively. The maintenance-recovery mechanisms 212K, 212C, 212M, and 212Y move relative to the recording heads 211K, 211C, 211M, and 211Y so that caps (not shown) of the maintenance-recovery mechanisms 212K, 212C, 212M, and 212Y oppose the nozzle surfaces of the recording heads 211K, 211C, 211M, and 211Y, respectively, so as to perform a maintenance operation, such as purge and wiping.

According to this exemplary embodiment, the recording heads 211K, 211C, 211M, and 211Y for discharging four-color liquids (e.g., black, cyan, magenta, and yellow liquids), respectively, are arranged in this order in a conveyance direction of a sheet 203. However, the recording heads 211K, 211C, 211M, and 211Y may be arranged in other order. Further, a number of liquid colors may not be limited to four. A plurality of rows of nozzles may be provided in one or more recording heads in such a manner that a predetermined distance is provided between the adjacent rows of nozzles. The recording heads 211K, 211C, 211M, and 211Y may be integrated with or separated from liquid cartridges (not shown) for supplying liquids to the recording heads 211K, 211C, 211M, and 211Y, respectively.

The feed roller 221 is formed in a half-moon-like shape. The feed roller 221 and a separation pad (not shown) feed sheets 203 one by one from the paper tray 204 toward the body 201. In the body 201, a sheet 203 is conveyed along the guide surface 223A of the convey guide 223 toward a nip formed between the registration roller 225 and the convey belt 233. The registration roller 225 feeds the sheet 203 onto the convey belt 233 at a predetermined time. The guide 226 guides the sheet 203 fed by the registration roller 225 onto the convey belt 233.

The convey belt 233 is formed in an endless belt shape, and is looped over the convey roller 231 serving as a driving roller and the driven roller 232 to rotate in a direction of rotation A. The charging roller 234 charges the convey belt 233. The platen 235 opposes the image forming device 202 to maintain flatness of the convey belt 233. The pressing roller 236 presses the sheet 203 conveyed on the convey belt 233 toward the convey roller 231. A cleaning roller (not shown), including a porous body, removes liquid adhered to the convey belt 233.

The output roller 238 and the spur 239 are provided downstream from the convey mechanism 205 in the conveyance direction of the sheet 203, and feed the sheet 203 bearing the image onto the output tray 206.

When a high voltage is applied to the charging roller 234, the charging roller 234 contacting the convey belt 233 positively charges the convey belt 233 rotating in the direction of rotation A. A polarity of charging voltage applied by the charging roller 234 is switched at a predetermined interval so as to charge the convey belt 233 at a predetermined charging pitch.

When the sheet 203 is fed onto the convey belt 233 charged at the high voltage, an inner portion of the sheet 203 is polarized and an electric charge having a polarity opposite to a polarity of an electric charge on the convey belt 233 is attracted to a contact surface of the sheet 203 contacting the convey belt 233. The electric charge on the convey belt 233 electrostatically attracts the electric charge on the contact surface of the sheet 203. Thus, the sheet 203 is electrostatically attracted to the convey belt 233. The sheet 203 adhered to the convey belt 233 may have a flat surface without bend or warp.

While the rotating convey belt 233 moves the sheet 203, the recording heads 211K, 211C, 211M, and 211Y discharge liquids onto the sheet 203 to form an image on the sheet 203. The output roller 238 feeds the sheet 203 bearing the image onto the output tray 206.

Figure 2:
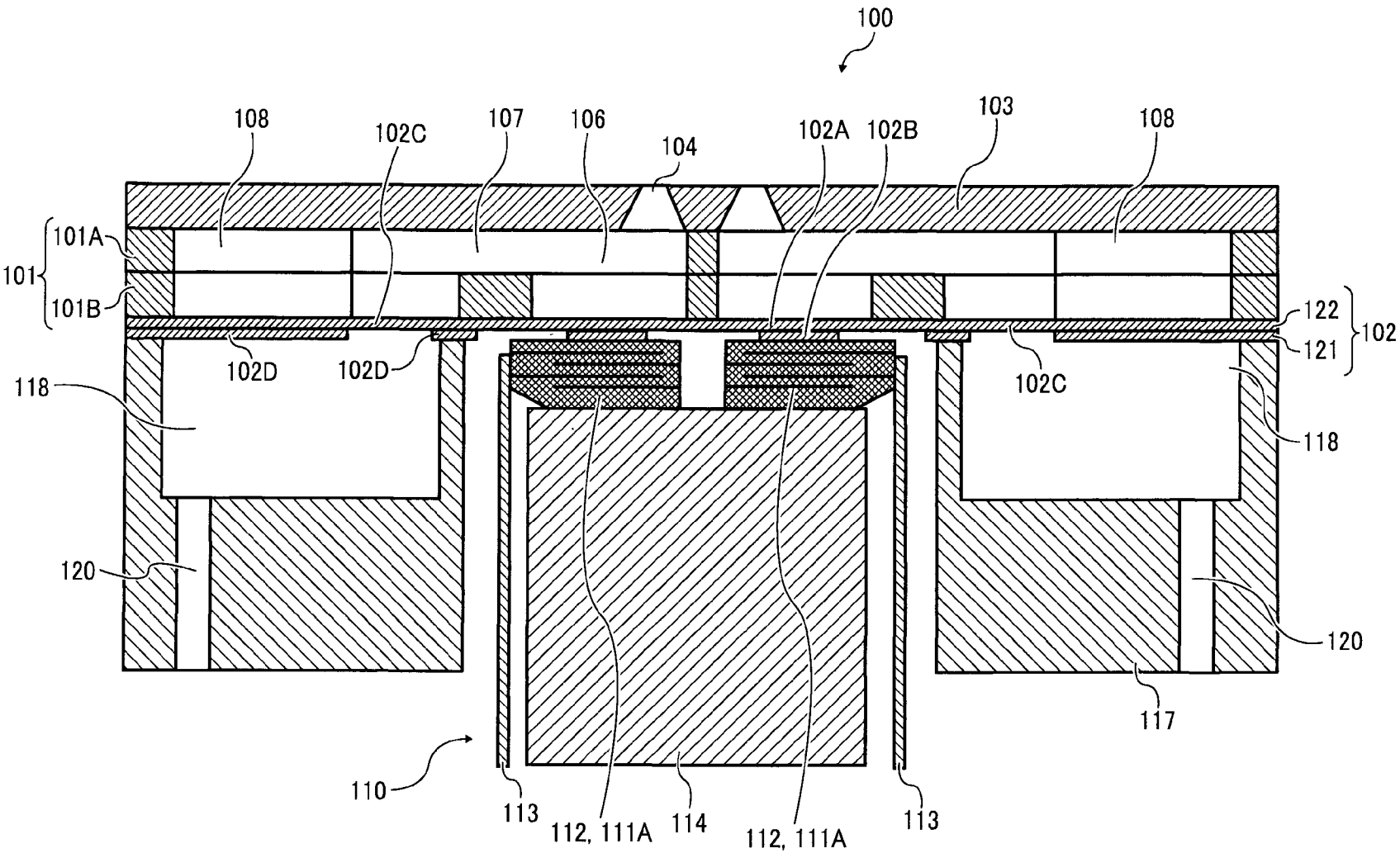
FIG. 2 is a sectional view of a liquid discharging head included in the image forming apparatus shown in FIG. 1 in a short direction of the liquid discharging head.
Figure 3:
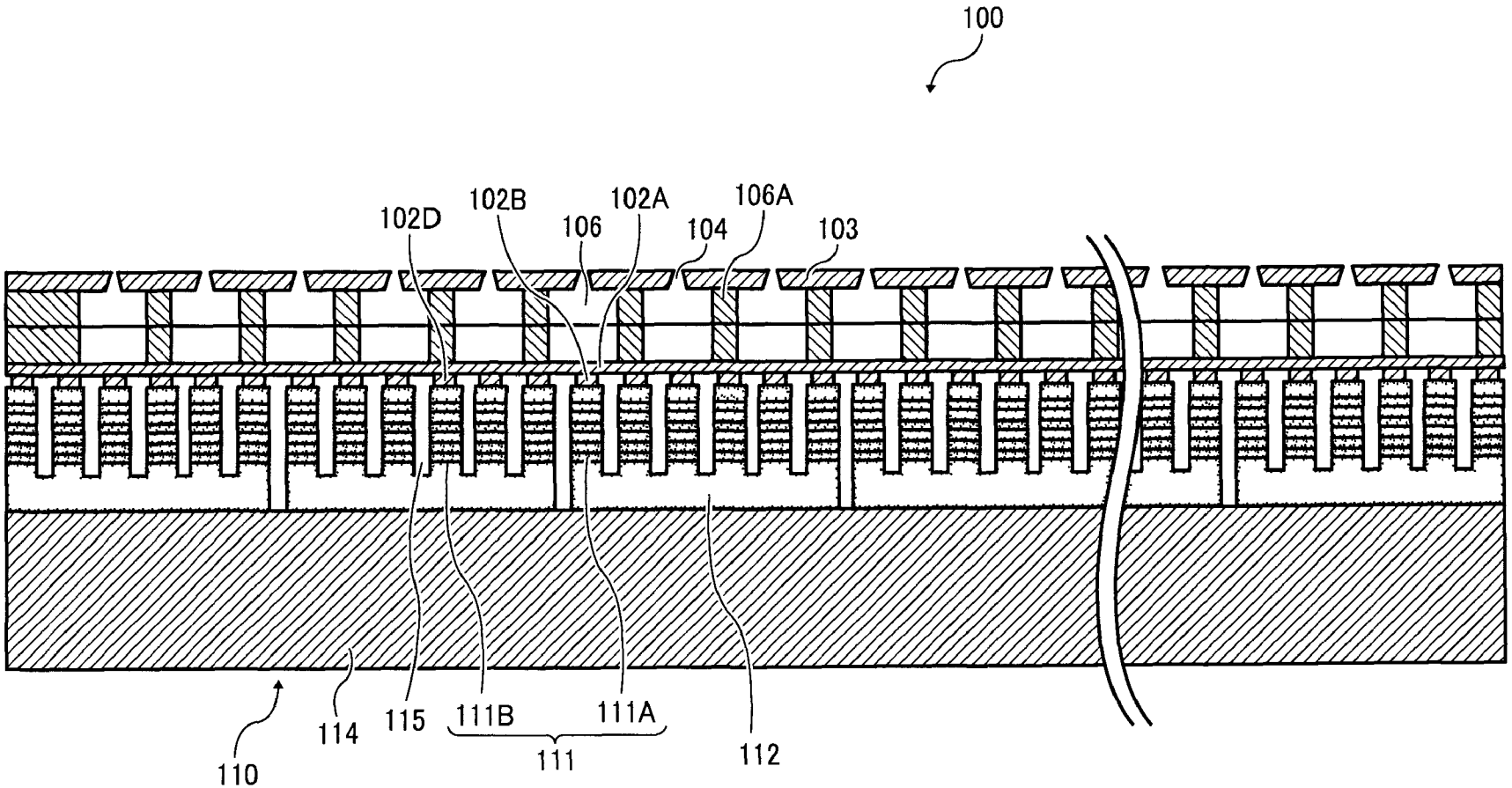
FIG. 3 is a sectional view of the liquid discharging head shown in FIG. 2 in a longitudinal direction of the liquid discharging head.

Referring to FIGS. 2 and 3, the following describes a liquid discharging head 100 equivalent to the recording head 211K, 211C, 211M, or 211Y depicted in FIG. 1. FIG. 2 is a sectional view of the liquid discharging head 100 in a short direction of the liquid discharging head 100. As illustrated in FIG. 2, the liquid discharging head 100 includes a base plate 101, a vibration plate 102, a nozzle plate 103, a nozzle 104, a pressing liquid chamber 106, a fluid resistance portion 107, a shared liquid chamber 108, a piezoelectric actuator 110, a frame 117, a diaphragm 102C, a buffer chamber 118, and a connecting route 120. The base plate 101 includes a restrictor plate 101A and a chamber plate 101B. The vibration plate 102 includes a metal member 121 and a resin member 122. The metal member 121 includes an island protrusion 102B and a thick portion 102D. The resin member 122 includes a vibration plate area 102A. The piezoelectric actuator 110 includes a piezoelectric element 112, a base 114, and a power supplier 113.

FIG. 3 is a sectional view of the liquid discharging head 100 in a longitudinal direction of the liquid discharging head 100, in a direction in which the pressing liquid chambers 106 are arranged; or in a short direction of the pressing liquid chamber 106. As illustrated in FIG. 3, the pressing liquid chamber 106 includes a wall 106A. The piezoelectric actuator 110 includes a slit groove 115. The piezoelectric element 112 includes a piezoelectric element column 111. The piezoelectric element column 111 includes a driven column 111A and a non-driven column 111B.

As illustrated in FIG. 2, the base plate 101 (e.g., a liquid chamber plate or a flow route plate) includes a SUS plate. The vibration plate 102 is attached to a bottom surface of the base plate 101. The nozzle plate 103 is attached to a top surface of the base plate 101. The nozzle 104 discharges a liquid drop. The base plate 101, the vibration plate 102, and the nozzle plate 103 form the pressing liquid chamber 106, the fluid resistance portion 107, and the shared liquid chamber 108. The pressing liquid chamber 106 (e.g., a liquid chamber, a pressure chamber, a pressing chamber, or a flow route) serves as a liquid (e.g., ink) flow route. The nozzle 104 is connected to the pressing liquid chamber 106. The fluid resistance portion 107 serves as a supply route for supplying liquid to the pressing liquid chamber 106. The shared liquid chamber 108 supplies liquid to a plurality of pressing liquid chambers 106. A liquid tank (not shown) supplies liquid to the shared liquid chamber 108 via a supply route (not shown).

The restrictor plate 101A and the chamber plate 101B are attached to each other to form the base plate 101. In the base plate 101, the SUS plate is etched with an acid etching liquid or is mechanically processed (e.g., stamped) to form openings such as the pressing liquid chamber 106, the fluid resistance portion 107, and the shared liquid chamber 108. For example, the fluid resistance portion 107 is shaped by forming an opening in a part of the restrictor plate 101A and not forming an opening in a part of the chamber plate 101B.

The vibration plate 102 is attached to the chamber plate 101B. The resin member 122 is directly coated on the metal member 121 to form the vibration plate 102. The metal member 121 includes a SUS base plate. A resin prepared to have a greater linear expansion coefficient than the metal member 121 is directly applied on the metal member 121, and is heated and solidified to form the resin member 122 (e.g., a resin layer). The vibration plate area 102A is included in the resin member 122, and forms a deformable wall of the pressing liquid chamber 106. The island protrusion 102B (e.g., an island convex) is included in the metal member 121, and is provided on a surface of the vibration plate area 102A opposite to a surface facing the pressing liquid chamber 106.

The wall 106A (depicted in FIG. 3) is formed of the base plate 101. The thick portion 102D is formed of the metal member 121, and is provided or remained at a position corresponding to the wall 106A. Alternatively, the vibration plate 102 may be formed of a resin member and a metal member adhered to each other with an adhesive, or may be electroformed with nickel.

As illustrated in FIG. 3, the nozzle plate 103 forms a plurality of nozzles 104 corresponding to a plurality of pressing liquid chambers 106. The nozzle 104 has a diameter of from about 10 μm to about 30 μm. The nozzle plate 103 is adhered to the restrictor plate 101A of the base plate 101 (depicted in FIG. 2) with an adhesive. The nozzle plate 103 may include a metal (e.g., stainless steel, nickel, and/or the like), a resin (e.g., polyimide resin film), silicon, and a mixture of the above. A water-repellent film is formed on a discharging surface of the nozzle 104 by a known method such as plating or coating with a repellent so as to provide water repellency against ink.

As illustrated in FIG. 2, the piezoelectric actuator 110 opposes an outer surface (e.g., a surface provided on an opposite side of a surface facing the pressing liquid chamber 106) of the vibration plate 102. In the piezoelectric actuator 110, a plurality (e.g., three or more) of piezoelectric elements 112 is arranged in a line on the base 114. The slit groove 115 (depicted in FIG. 3) is formed by slit (e.g., groove) processing in each of the piezoelectric element 112, so as to form a plurality of piezoelectric element columns 111 (depicted in FIG. 3). A pitch of the piezoelectric element columns 111 may vary among the piezoelectric elements 112. The piezoelectric element columns 111 include the driven columns 111A and the non-driven columns 111B (depicted in FIG. 3) arranged alternately.

The power supplier 113 includes an electrode (not shown) provided in correspondence to the driven column 111A. An FPC (flexible printed circuit) is used as the power supplier 113.

As illustrated in FIG. 3, the driven column 111A is adhered to the island protrusion 102B with an adhesive. The non-driven column 111B is adhered to the thick portion 102D corresponding to the wall 106A with an adhesive.

In the piezoelectric element 112, a piezoelectric layer and an internal electrode layer are layered alternately. The piezoelectric layer has a thickness of from about 10 μm to about 50 μm each, and includes lead zirconate titanate (PZT). The internal electrode layer has a thickness of several micrometers each, and includes argent palladium (AgPd). The internal electrode layers are electrically connected to an individual electrode (not shown) and a shared electrode (not shown) alternately. The individual electrode and the shared electrode serve as end electrodes or external electrodes. The power supplier 113 (depicted in FIG. 2) is soldered to the individual electrode and the shared electrode. The piezoelectric element 112 has a piezoelectric constant d33 indicating expansion and contraction in a direction perpendicular to a surface of the internal electrode layer or a thickness direction of the internal electrode layer. Expansion and contraction of the driven column 111A of the piezoelectric element 112 displaces the vibration plate area 102A to expand and contract the pressing liquid chamber 106. When a driving signal is applied to charge the driven column 111A, the pressing liquid chamber 106 expands. When the driven column 111A is discharged, the pressing liquid chamber 106 contracts in a direction opposite to a direction in which the pressing liquid chamber 106 expands.

According to this exemplary embodiment, the piezoelectric element 112 (e.g., the driven column 111A) is displaced in a direction d33 to apply pressure to ink in the pressing liquid chamber 106. Alternatively, the piezoelectric element 112 may be displaced in a direction d31, that is, a direction parallel to the surface of the internal electrode layer, to apply pressure to ink in the pressing liquid chamber 106.

The base 114 may preferably include a metal material to prevent the piezoelectric element 112 from storing heat generated by the piezoelectric element 112.

As illustrated in FIG. 2, the frame 117 is adhered to a circumferential portion of the vibration plate 102 with an adhesive. The diaphragm 102C is formed of the resin member 122 of the vibration plate 102, and is deformable. The buffer chamber 118 is formed of the frame 117, and is provided adjacent to the shared liquid chamber 108 via the diaphragm 102C. The diaphragm 102C forms a wall of the shared liquid chamber 108 and the buffer chamber 118. Air enters or goes out of the buffer chamber 118 via the connecting route 120.

As illustrated in FIG. 3, the liquid discharging head 100 includes two rows of the driven columns 111A and the non-driven columns 111B of the piezoelectric elements 112 opposing each other in such a manner that a gap of about 300 dpi is provided between the adjacent driven column 111A and the non-driven column 111B. The liquid discharging head 100 includes two rows of the pressing liquid chambers 106 and the nozzles 104 staggered in such a manner that a gap of about 150 dpi is provided between the adjacent pressing liquid chambers 106 and between the adjacent nozzles 104 in a single row. Thus, the liquid discharging head 100 provides a resolution of about 300 dpi for a single scan.

As described above, most of the elements included in the liquid discharging head 100 include SUS. Thus, the elements included in the liquid discharging head 100 have an identical thermal-expansion coefficient, preventing or reducing problems caused by thermal expansion of the elements when the liquid discharging head 100 is manufactured or used.

In the liquid discharging head 100 having the above-described structure, when a voltage applied to the driven column 111A of the piezoelectric element 112 is decreased from a reference electric potential, the driven column 111A is contracted to lower the vibration plate 102A. Accordingly, the volume of the pressing liquid chamber 106 is increased, and ink is flown into the pressing liquid chamber 106. Then, a voltage applied to the driven column 111A is increased to expand the driven column 111A in a layered direction in which the piezoelectric layer and the internal electrode layer are layered. Consequently, the vibration plate 102A is deformed. For example, the vibration plate 102A is pressed toward the nozzle 104. Accordingly, the volume of the pressing liquid chamber 106 is decreased to apply pressure to ink in the pressing liquid chamber 106. Thus, an ink drop is discharged (e.g., ejected) from the nozzle 104.

When the voltage applied to the driven column 111A is returned to the reference electric potential, the vibration plate 102A returns to the original position. Accordingly, the pressing liquid chamber 106 is expanded to generate a negative pressure. Ink is flown from the shared liquid chamber 108 (depicted in FIG. 2) to fill the pressing liquid chamber 106. Vibration of a meniscus surface of the nozzle 104 is damped and stabilized to start a next liquid drop discharging operation.

The method for driving the liquid discharging head 100 is not limited to the above-described example for decreasing and increasing the volume of the pressing liquid chamber 106. Alternatively, the volume of the pressing liquid chamber 106 may be decreased and increased by changing application of a driving waveform.

Figure 4:
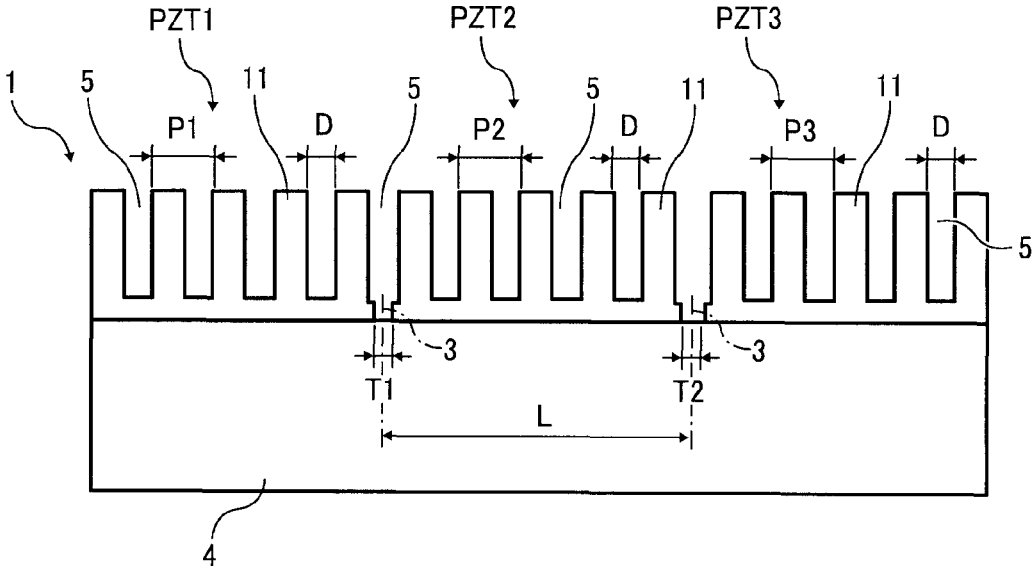
FIG. 4 is a schematic view of a piezoelectric actuator included in the liquid discharging head shown in FIG. 2.
Figure 5:
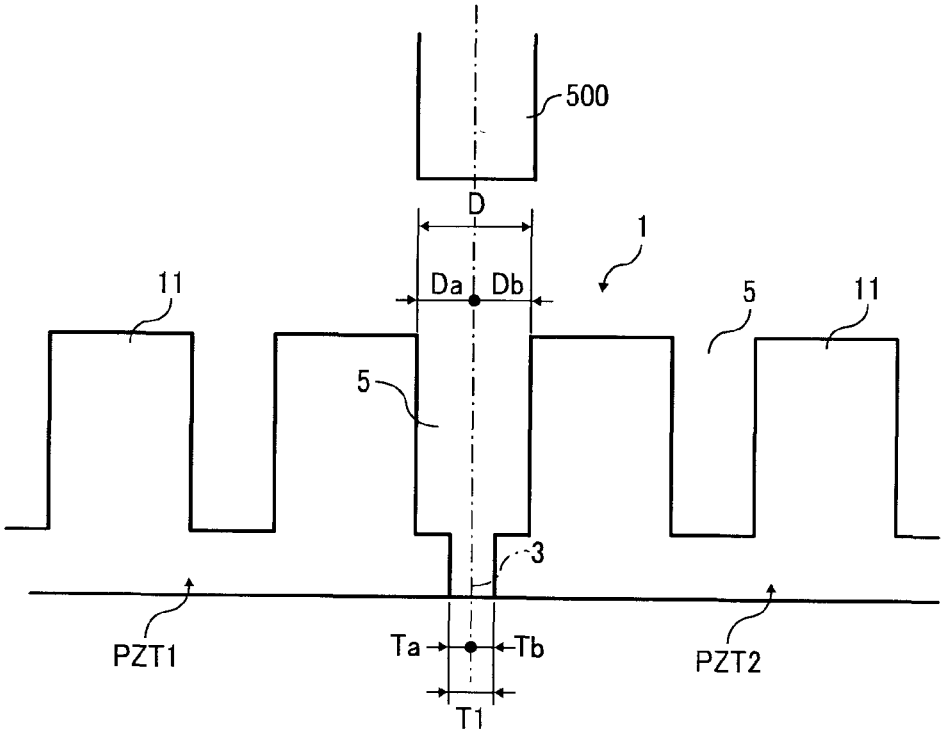
FIG. 5 is an enlarged view of the piezoelectric actuator shown in FIG. 4 and a processing blade used in the piezoelectric actuator.

Referring to FIGS. 4 and 5, the following describes a piezoelectric actuator 1 according to an exemplary embodiment. FIG. 4 is a schematic view of the piezoelectric actuator 1. FIG. 5 is an enlarged view of the piezoelectric actuator 1 and a processing blade 500. As illustrated in FIG. 4, the piezoelectric actuator 1 includes piezoelectric elements PZT1, PZT2, and PZT3, a base 4, a clearance 3, a groove 5, and a piezoelectric element column 11.

The piezoelectric actuator 1 is equivalent to the piezoelectric actuator 110 depicted in FIG. 2. Three piezoelectric elements PZT1, PZT2, and PZT3 (alternatively, hereinafter collectively referred to as piezoelectric elements PZT) are arranged and adhered in a line on the base 4 in such a manner that the clearances 3 are provided between the adjacent piezoelectric elements PZT1 and PZT2 and between the adjacent piezoelectric elements PZT2 and PZT3, respectively. Alternatively, more than three piezoelectric elements PZT may be arranged. The groove 5 having a width D is formed in the piezoelectric element PZT without dividing the piezoelectric element PZT to form a plurality of piezoelectric element columns 11. Thus, the piezoelectric elements PZT are arranged in a line in a direction in which the piezoelectric element columns 11 are arranged. The groove 5 is also provided between the adjacent piezoelectric elements PZT.

The clearance 3 provided between the piezoelectric elements PZT1 and PZT2 has a width T1. The clearance 3 provided between the piezoelectric elements PZT2 and PZT3 has a width T2. The piezoelectric element column 11 included in the piezoelectric element PZT1 has a pitch P1. The piezoelectric element column 11 included in the piezoelectric element PZT2 has a pitch P2. The piezoelectric element column 11 included in the piezoelectric element PZT3 has a pitch P3. The pitches P1, P2, and P3 are different from each other.

The pitches P1, P2, and P3 different from each other may decrease variation in drive performance of the piezoelectric element columns 11 and may prevent degraded quality of processing the clearances 3, even when the piezoelectric elements PZT1, PZT2, and PZT3 and the clearances 3 are not manufactured or provided with high dimensional precision.

As illustrated in FIG. 5, to form the groove 5 having the width D in the clearance 3 having the width T1 and provided between the adjacent piezoelectric elements PZT1 and PZT2 with the processing blade 500 (e.g., a dicing blade), the processing blade 500 is placed at a position at which a center of the clearance 3 between the adjacent piezoelectric elements PZT1 and PZT2 corresponds to a center of the groove 5 to be formed in the clearance 3. For example, a width Da equals to a width Db and a width Ta equals to a width Tb. Thus, when the processing blade 500 forms the groove 5 in the clearance 3 between the piezoelectric elements PZT1 and PZT2, the processing blade 500 may not be obliquely inserted in the clearance 3, preventing degraded quality of processing the clearance 3. Similarly, to form the groove 5 in the clearance 3 having the width T2 and provided between the piezoelectric elements PZT2 and PZT3 (depicted in FIG. 4), the processing blade 500 is placed at a position at which a center of the clearance 3 between the adjacent piezoelectric elements PZT2 and PZT3 corresponds to a center of the groove 5 to be formed in the clearance 3.

As illustrated in FIG. 4, in the piezoelectric element PZT2, the pitch P2 of the piezoelectric element column 11 is determined based on a distance L between the clearances 3 facing the piezoelectric element PZT2 so as to form a desired number of piezoelectric element columns 11. In the piezoelectric elements PZT1 and PZT3, each of the pitches P1 and P3 of the piezoelectric element columns 11 is determined based on a distance from the center of the clearance 3 so as to form a desired number of piezoelectric element columns 11. Therefore, the plurality of piezoelectric elements PZT1, PZT2, and PZT3 may have the pitches P1, P2, and P3 of the piezoelectric element columns 11 different from each other, respectively. However, when the length of each of the piezoelectric elements PZT1, PZT2, and PZT3 and the dimension of each of the clearances 3 are in a certain range, the different pitches P1, P2, and P3 of the piezoelectric element columns 11 may suppress variation in drive performance of the piezoelectric element columns 11 due to the different pitches P1, P2, and P3 within a practical, allowable range.

Figure 6:
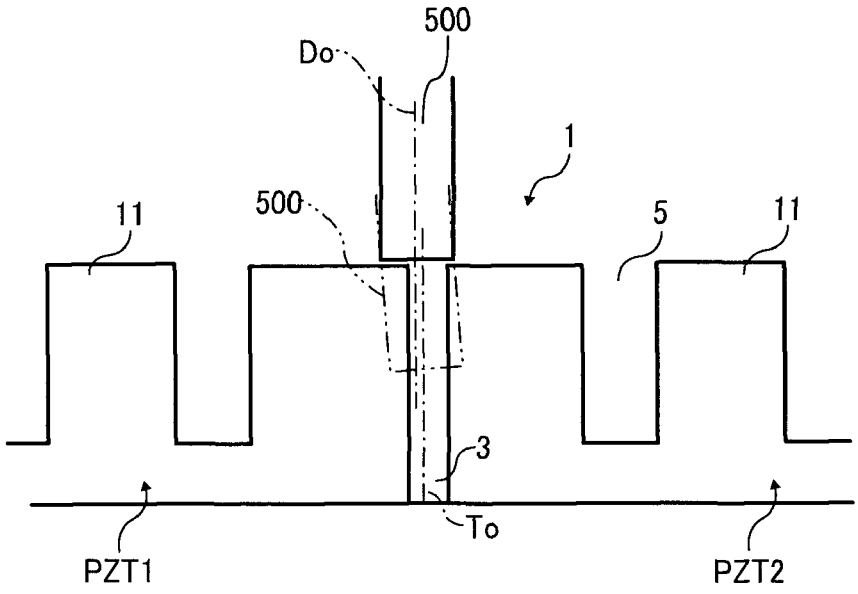
FIG. 6 is another enlarged view of the piezoelectric actuator and the processing blade shown in FIG. 5.

By contrast, as illustrated in FIG. 6, when the pitches P1, P2, and P3 (depicted in FIG. 4) of the piezoelectric element columns 11 are equal to each other and the processing blade 500 forms the groove 5, a center Do of the processing blade 500 may deviate from a center To of the clearance 3 between the piezoelectric elements PZT1 and PZT2. Accordingly, the processing blade 500 may be obliquely inserted into the clearance 3 as illustrated in a broken line in FIG. 6. Thus, the processing blade 500 may process the piezoelectric element column 11 of the piezoelectric element PZT1 facing the clearance 3 and the piezoelectric element column 11 of the piezoelectric element PZT2 facing the clearance 3 to have widths substantially different from widths of other piezoelectric element columns 11 not facing the clearance 3, resulting in unallowable variation in drive performance of the piezoelectric element columns 11. To address this problem, the piezoelectric elements PZT1 and PZT2 and the clearance 3 between the piezoelectric elements PZT1 and PZT2 need to be manufactured with high precision, resulting in a complex assembly process of the liquid discharging head 100 (depicted in FIG. 3) and increased costs.

As illustrated in FIG. 4, according to this exemplary embodiment, three or more piezoelectric elements PZT1, PZT2, and PZT3 are arranged in a line in a direction in which the piezoelectric element columns 11 are arranged. In each of the piezoelectric elements PZT1, PZT2, and PZT3, a plurality of piezoelectric element columns 11 is formed in such a manner that the groove 5 is provided between the adjacent piezoelectric element columns 11. At least two of the three or more piezoelectric elements PZT1, PZT2, and PZT3 have the pitches P1, P2, and P3 different from each other. Thus, even when the piezoelectric elements PZT1, PZT2, and PZT3 and the clearances 3 are not manufactured or provided with high dimensional precision, variation in drive performance of the piezoelectric element columns 11 may be decreased and degraded quality in processing the clearance 3 may be prevented.

Figure 7:
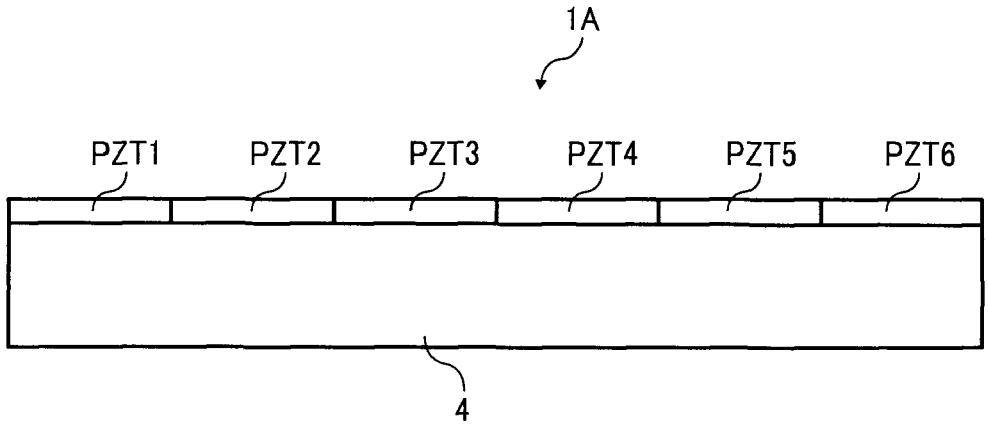
FIG. 7 is a schematic view of a modified example of the piezoelectric actuator shown in FIG. 4.

FIG. 4 illustrates the piezoelectric actuator 1 in which three piezoelectric elements PZT1, PZT2, and PZT3 are arranged in a line on the base 4. However, a number of piezoelectric elements may not be limited to three. FIG. 7 is a schematic view of a piezoelectric actuator 1A as a modified example of the piezoelectric actuator 1 depicted in FIG. 4. The piezoelectric actuator 1A includes six piezoelectric elements PZT1, PZT2, PZT3, PZT4, PZT5, and PZT6. The other elements of the piezoelectric actuator 1A are common to the piezoelectric actuator 1 depicted in FIG. 4.

The six piezoelectric elements PZT1, PZT2, PZT3, PZT4, PZT5, and PZT6 each having a width of about 50 mm are arranged in a line on the base 4 having a width of about 300 mm. A center of the clearance 3 (depicted in FIG. 5) between the adjacent piezoelectric elements PZT (e.g., the clearance 3 between the piezoelectric elements PZT1 and PZT2, the clearance 3 between the piezoelectric elements PZT2 and PZT3, the clearance 3 between the piezoelectric elements PZT3 and PZT4, the clearance 3 between the piezoelectric elements PZT4 and PZT5, and the clearance 3 between the piezoelectric elements PZT5 and PZT6) corresponds to a center of the groove 5 (depicted in FIG. 5). One piezoelectric element PZT may include 590 grooves 5. In this case, the piezoelectric element column 11 (depicted in FIG. 5) has a width of about 10 μm. The groove 5 has a width of about 30 μm and a depth of about 640 μm.

Figure 8:
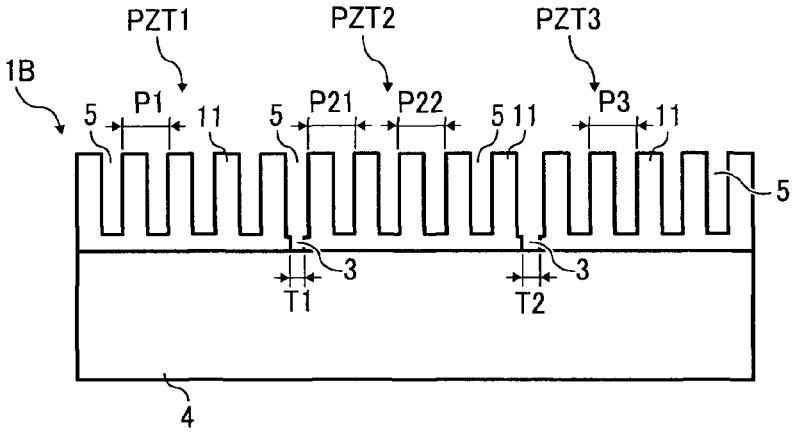
FIG. 8 is a schematic view of a piezoelectric actuator according to another exemplary embodiment.

Referring to FIG. 8, the following describes a piezoelectric actuator 1B according to another exemplary embodiment. FIG. 8 is a schematic view of the piezoelectric actuator 1B. The piezoelectric actuator 1B includes the elements common to the piezoelectric actuator 1 (depicted in FIG. 4). However, in the piezoelectric element PZT2, a pitch P21 of an endmost piezoelectric element column 11 of the piezoelectric element PZT2 is different from a pitch P22 of a center piezoelectric element column 11 of the piezoelectric element PZT2. The pitch of the piezoelectric element column 11 may become larger or smaller from the endmost piezoelectric element column 11 to the center piezoelectric element column 11. For example, the pitch P22 of the center piezoelectric element column 11 may be larger or smaller than the pitch P21 of the endmost piezoelectric element column 11. Alternatively, the pitch of the piezoelectric element column 11 may vary at random.

As described above, the piezoelectric element columns 11 adjacent to (e.g., facing) the clearance 3 may deform the processing blade 500 (depicted in FIG. 6) due to variation in width of the clearance 3 or deformation of an adhesive used for adhering the piezoelectric element PZT to the base 4, resulting in varied shapes of the piezoelectric element column 11. However, when one piezoelectric element PZT includes the piezoelectric element columns 11 having varied pitches (e.g., the pitches P21 and P22), not only the piezoelectric element columns 11 adjacent to the clearance 3 but also the piezoelectric element columns 11 unadjacent to the clearance 3 may have the pitch different from the pitch of other piezoelectric element columns 11. Thus, the varied shapes of the piezoelectric element columns 11 may not be conspicuous. As a result, a plurality of piezoelectric element columns 11 included in one piezoelectric element PZT may provide reduced variation in drive performance of the piezoelectric element columns 11.

Figure 9:
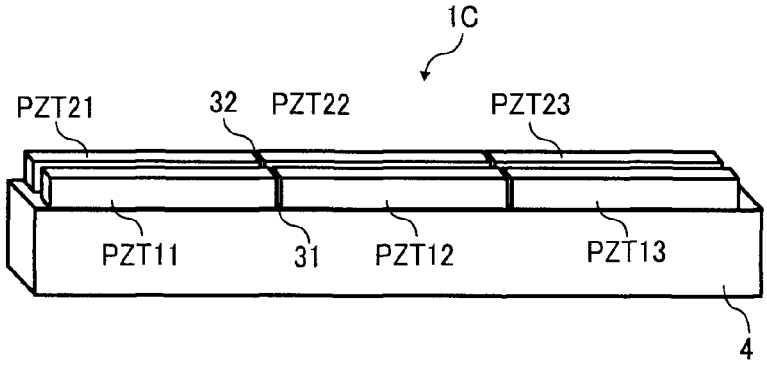
FIG. 9 is a perspective view of a piezoelectric actuator according to yet another exemplary embodiment.
Figure 10:
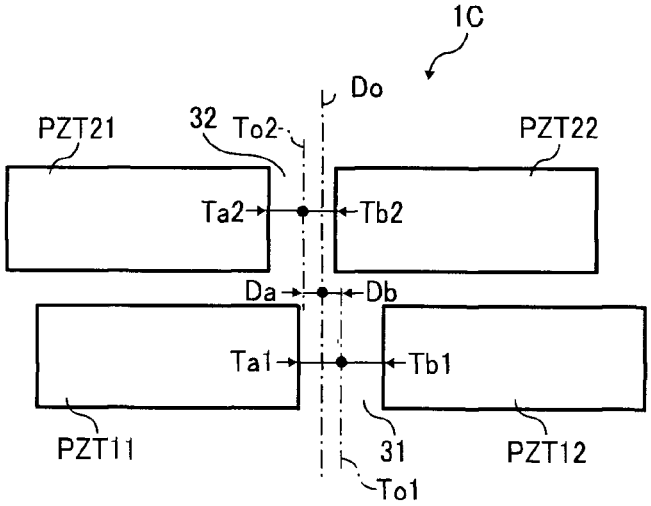
FIG. 10 is a plane view of the piezoelectric actuator shown in FIG. 9.

Referring to FIGS. 9 and 10, the following describes a piezoelectric actuator 1C according to yet another exemplary embodiment. FIG. 9 is a perspective view of the piezoelectric actuator 1C. FIG. 10 is a plane view of the piezoelectric actuator 1C. As illustrated in FIG. 9, the piezoelectric actuator 1C includes piezoelectric elements PZT11, PZT12, PZT13, PZT21, PZT22, and PZT23, clearances 31 and 32, and the base 4.

According to this exemplary embodiment, three or more piezoelectric elements PZT may be arranged in a line on a single base 4, and two rows of the three or more piezoelectric elements PZT may be arranged on the single base 4. For example, as illustrated in FIG. 9, three piezoelectric elements PZT11, PZT12, and PZT13 form a row (e.g., a first row) and three piezoelectric elements PZT21, PZT22, and PZT23 form another row (e.g., a second row).

The clearance 31 is provided between the adjacent piezoelectric elements PZT11 and PZT12. The clearance 32 is provided between the adjacent piezoelectric elements PZT21 and PZT22. Variation in width and arrangement of the piezoelectric elements PZT may cause misalignment of the clearances 31 and 32 between the first and second rows of the piezoelectric elements PZT, as illustrated in FIG. 10. To address this problem, the center Do of the groove 5 (depicted in FIG. 6) is positioned based on an average of widths of the clearances 31 and 32. A center To1 is provided at a center of the clearance 31 between the piezoelectric elements PZT11 and PZT12 forming the first row. Namely, a width Ta1 equals to a width Tb1. A center To2 is provided at a center of the clearance 32 between the piezoelectric elements PZT21 and PZT22 forming the second row. Namely, a width Ta2 equals to a width Tb2. The center Do is provided at a center between the centers To1 and To2. Namely, a width Da equals to a width Db. The center Do is used as a center of the processing blade 500 (depicted in FIG. 5) and a center of the groove 5 (depicted in FIG. 5) formed by the processing blade 500. Thus, an amount of misalignment between the first and second rows of the piezoelectric elements PZT may be decreased to improve processing quality.

Figure 11A:
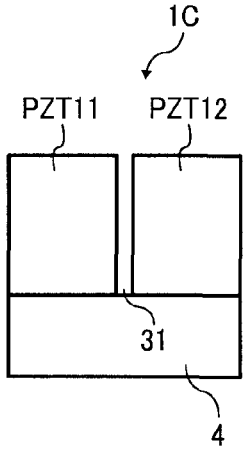
FIG. 11A is a sectional view of the piezoelectric actuator shown in FIG. 9 before groove formation.
Figure 11B:
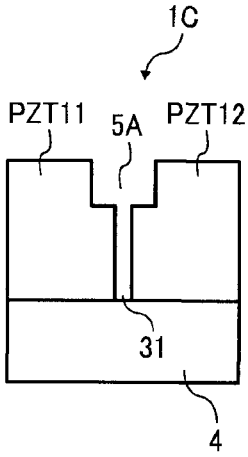
FIG. 11B is a sectional view of the piezoelectric actuator shown in FIG. 9 during groove formation.
Figure 11C:
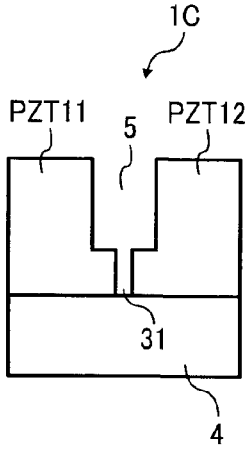
FIG. 11C is a sectional view of the piezoelectric actuator shown in FIG. 9 after groove formation.

Referring to FIGS. 11A, 11B, and 11C, the following describes how to process the clearance 31 between the piezoelectric elements PZT11 and PZT12. As illustrated in FIG. 11B, the piezoelectric actuator 1C further includes a groove 5A.

The processing blade 500 (depicted in FIG. 5) processes the clearance 31 between the piezoelectric elements PZT11 and PZT12 illustrated in FIG. 11A to form the groove 5A illustrated in FIG. 11B. After the processing blade 500 is temporarily retreated from the groove 5A, the processing blade 500 is inserted into the groove 5A to form the groove 5 illustrated in FIG. 11C. When the processing blade 500 processes the clearance 31 in a depth direction of the groove 5 for a plurality of times to form the groove 5, the processing blade 500 may provide processing quality better than processing quality provided when the processing blade 500 is inserted once into a deeper position in the groove 5. Especially, when the piezoelectric actuator 1C includes a plurality of rows formed by the piezoelectric elements PZT and the processing blade 500 simultaneously processes the clearances 31 and 32 (depicted in FIG. 10) shifted from each other in a direction in which the plurality of rows extends, the processing blade 500 may provide improved processing quality.

Figure 12:
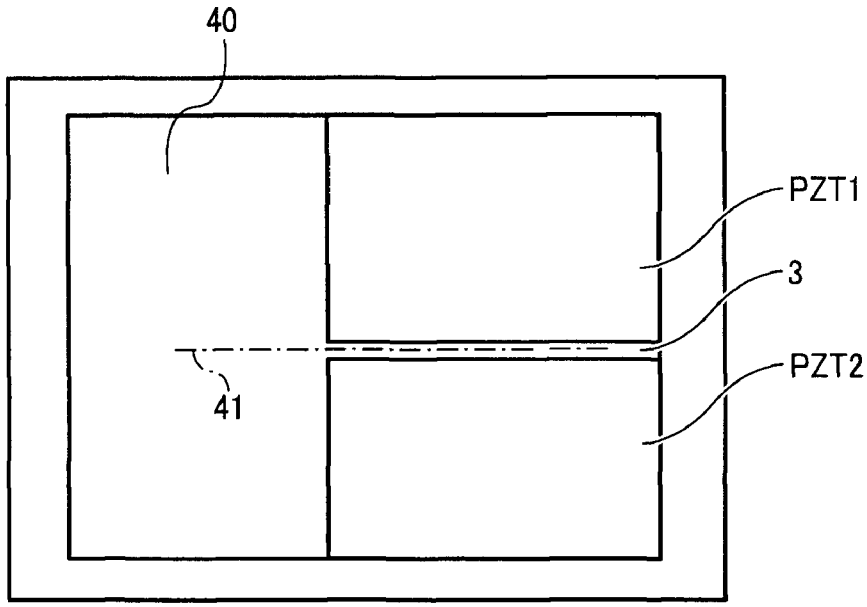
FIG. 12 is an illustration of a monitor screen used for manufacturing the piezoelectric actuator shown in FIG. 4.
Figure 13:
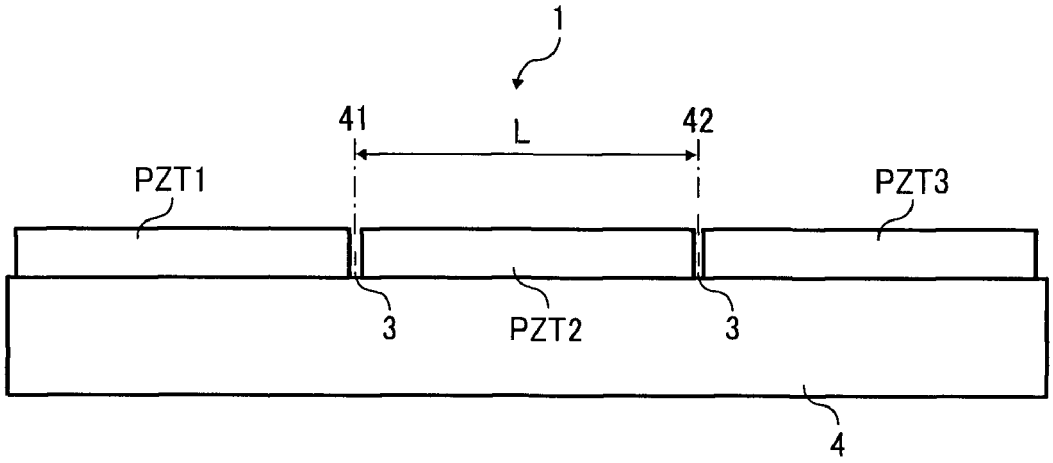
FIG. 13 is a schematic view of the piezoelectric actuator shown in FIG. 4 for explaining a manufacturing method for manufacturing the piezoelectric actuator.

Referring to FIGS. 12 and 13, the following describes a manufacturing method for manufacturing the piezoelectric actuator 1. However, the manufacturing method may be applied to the piezoelectric actuator 1A depicted in FIG. 7, the piezoelectric actuator 1B depicted in FIG. 8, or the piezoelectric actuator 1C depicted in FIG. 9. FIG. 12 is an illustration of a monitor screen 40. FIG. 13 is a schematic view of the piezoelectric actuator 1.

As illustrated in FIG. 13, the piezoelectric elements PZT1, PZT2, and PZT3 are arranged and attached in a line on the base 4 in such a manner that the clearances 3 are provided between the adjacent piezoelectric elements PZT1 and PZT2 and between the adjacent piezoelectric elements PZT2 and PZT3, respectively. A shooting device (not shown), such as a CCD (charge-coupled device) and a camera, shoots an image of the clearance 3 between the piezoelectric elements PZT1 and PZT2. As illustrated in FIG. 12, the monitor screen 40 displays the image of the clearance 3 between the piezoelectric elements PZT1 and PZT2 so that a proper position in the clearance 3 is specified as a processing reference position 41. Similarly, as illustrated in FIG. 13, the shooting device shoots an image of the clearance 3 between the piezoelectric elements PZT2 and PZT3, and the monitor screen 40 (depicted in FIG. 12) displays the image of the clearance 3 between the piezoelectric elements PZT2 and PZT3 so that a proper position in the clearance 3 is specified as a processing reference position 42. Thus, a distance L between the specified processing reference positions 41 and 42 is measured.

In the piezoelectric actuator 1 depicted in FIG. 4, a specified number of grooves 5 of the piezoelectric element PZT2 may be formed so that equal pitches are provided in the distance L between the specified processing reference positions 41 and 42 (depicted in FIG. 13). In the piezoelectric actuator 1B depicted in FIG. 8, a specified number of grooves 5 of the piezoelectric element PZT2 may be formed so that unequal pitches are partially provided in the distance L between the specified processing reference positions 41 and 42. In this case, the pitch of the piezoelectric element column 11 may become larger or smaller from the endmost piezoelectric element column 11 to the center piezoelectric element column 11. For example, the pitch P22 of the center piezoelectric element column 11 may be larger or smaller than the pitch P21 of the endmost piezoelectric element column 11. Alternatively, the pitch of the piezoelectric element column 11 may vary at random. As illustrated in FIG. 13, specification of the proper positions in the clearances 3 as the processing reference positions 41 and 42, measurement of the distance L between the specified processing reference positions 41 and 42, and calculation may be performed manually or automatically.

The manufacturing method for manufacturing the piezoelectric actuator 1 includes an arrangement process for arranging three or more piezoelectric elements PZT1, PZT2, and PZT3 in a line on the base 4 in such a manner that the clearances 3 are provided between the adjacent piezoelectric elements PZT1 and PZT2 and between the adjacent piezoelectric elements PZT2 and PZT3, respectively. The manufacturing method further includes a measurement process for measuring the distance L between the clearances 3, a calculation process for calculating the pitch of the piezoelectric element column 11 depicted in FIG. 4 based on a measurement result, and a groove formation process for forming the groove 5 (depicted in FIG. 4) corresponding to the calculated pitch of the piezoelectric element column 11. Thus, even when the piezoelectric elements PZT1, PZT2, and PZT3 and the clearances 3 are not manufactured and arranged with high dimensional precision, variation in drive performance of the piezoelectric element columns 11 may be decreased and degraded quality in processing the clearance 3 may be prevented.

Figure 14:
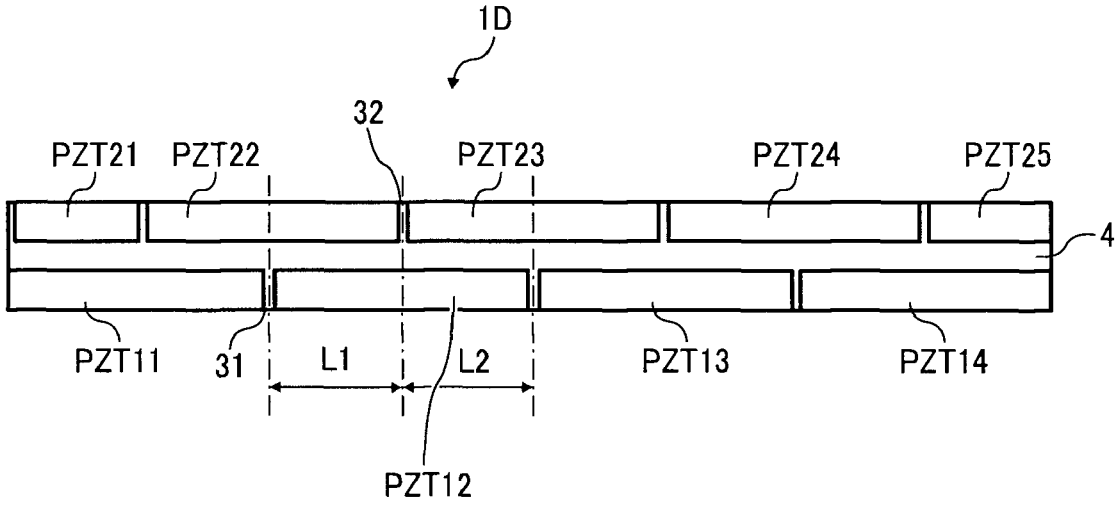
FIG. 14 is a plane view of a piezoelectric actuator according to yet another exemplary embodiment.

Referring to FIG. 14, the following describes a piezoelectric actuator 1D according to yet another exemplary embodiment. FIG. 14 is a plane view of the piezoelectric actuator 1D before the grooves 5 (depicted in FIG. 4) are formed. The piezoelectric actuator 1D includes piezoelectric elements PZT11, PZT12, PZT13, PZT14, PZT21, PZT22, PZT23, PZT24, and PZT25, the clearances 31 and 32, and the base 4.

Four piezoelectric elements PZT11 to PZT14 are arranged in a line on the base 4 in such a manner that the clearances 31 are provided between the adjacent piezoelectric elements PZT11 and PZT12, between the adjacent piezoelectric elements PZT12 and PZT13, and between the adjacent piezoelectric elements PZT13 and PZT14, respectively. Five piezoelectric elements PZT21 to PZT25 are arranged in a line on the base 4 in such a manner that the clearances 32 are provided between the adjacent piezoelectric elements PZT21 and PZT22, between the adjacent piezoelectric elements PZT22 and PZT23, between the adjacent piezoelectric elements PZT23 and PZT24, and between the adjacent piezoelectric elements PZT24 and PZT25, respectively. The clearances 31 provided in one row of the piezoelectric elements PZT11 to PZT14 are staggered with respect to the clearances 32 provided in another row of the piezoelectric elements PZT21 to PZT25. The clearances 31 may have size equal to or different from size of the clearances 32.

To process the piezoelectric elements PZT, for example, the clearance 31 between the piezoelectric elements PZT11 and PZT12 and the clearance 32 between the piezoelectric elements PZT22 and PZT23 are detected. For the piezoelectric element PZT12, distances L1 and L2 are measured. The distance L1 denotes a distance from the clearance 31 between the piezoelectric elements PZT11 and PZT12 to a position on the piezoelectric element PZT12 corresponding to the clearance 32 between the piezoelectric elements PZT22 and PZT23. The distance L2 denotes a distance from the position on the piezoelectric element PZT12 corresponding to the clearance 32 between the piezoelectric elements PZT22 and PZT23 to the clearance 31 between the piezoelectric elements PZT12 and PZT13. An area corresponding to the distance L1 may be processed to form the grooves 5 (depicted in FIG. 4) so that the piezoelectric element columns 11 (depicted in FIG. 4) have pitches equal to or different from each other based on the distance L1. An area corresponding to the distance L2 may be processed to form the grooves 5 so that the piezoelectric element columns 11 have pitches equal to or different from each other based on the distance L2.

Accordingly, the clearances 31 and 32 may not be processed simultaneously, improving processing quality of the clearances 31 and 32. According to this exemplary embodiment, the clearances 31 in one row of the piezoelectric elements PZT11 to PZT14 are staggered with respect to the clearances 32 in another row of the piezoelectric elements PZT21 to PZT25. However, the clearances 31 and 32 may be provided at other positions as long as the clearances 31 and 32 are shifted from each other in a processing direction.

In this case, when a center of the clearance 31 in one row of the piezoelectric elements PZT corresponds to a center of the groove 5 in another row of the piezoelectric elements PZT, the two rows of the piezoelectric elements PZT may be processed to form the grooves 5 simultaneously.

According to this exemplary embodiment, the piezoelectric actuator 1D includes a plurality of rows in each of which three or more piezoelectric elements PZT are arranged in a line in such a manner that the clearance 31 or 32 is provided between the adjacent piezoelectric elements PZT. In each of the piezoelectric elements PZT, a plurality of piezoelectric element columns 11 is arranged in a direction in which the three or more piezoelectric elements PZT are arranged, in such a manner that the groove 5 is provided between the adjacent piezoelectric element columns 11. The clearances 31 in one row of the piezoelectric elements PZT are shifted from the clearances 32 in another row of the piezoelectric elements PZT, respectively, in a direction in which the rows extend. In one piezoelectric element PZT (e.g., the piezoelectric element PZT12), an area between the clearance 31 facing one end of the piezoelectric element PZT12 and a position corresponding to the clearance 32 between the piezoelectric elements PZT22 and PZT23 in an adjacent row of the piezoelectric elements PZT21 to PZT25 has the pitch of the piezoelectric element columns 11 different from the pitch of the piezoelectric element columns 11 in an area between the clearance 31 facing another end of the piezoelectric element PZT12 and the position corresponding to the clearance 32 between the piezoelectric elements PZT22 and PZT23 in the adjacent row of the piezoelectric elements PZT21 to PZT25. Therefore, the clearances 31 and 32 provided in the different rows, respectively, may not be processed simultaneously. Thus, even when the piezoelectric elements PZT and the clearances 31 and 32 are not manufactured and arranged with high dimensional precision, variation in drive performance of the piezoelectric element columns 11 may be decreased and degraded quality in processing the clearances 31 and 32 may be prevented.

As illustrated in FIG. 1, the image forming apparatus 200 includes the recording heads 211K, 211C, 211M, and 211Y serving as the liquid discharging heads 100 depicted in FIG. 3. The liquid discharging head 100 includes the piezoelectric actuator 1 (depicted in FIG. 4), 1A (depicted in FIG. 7), 1B (depicted in FIG. 8), 1C (depicted in FIG. 9), or 1D (depicted in FIG. 14), providing a long liquid discharging head with decreased variation in liquid discharging performance. Therefore, the image forming apparatus 200 may form a high-quality image with decreased variation in liquid discharging performance. Further, the image forming apparatus 200 may form an image at an increased speed and low costs by using the recording heads 211K, 211C, 211M, and 211Y providing increased reliability. In the image forming apparatus 200, the liquid discharging device (e.g., the image forming device 202) including the recording heads 211K, 211C, 211M, and 211Y and a driver for driving the recording heads 211K, 211C, 211M, and 211Y may provide liquid discharging with improved reliability at decreased costs.

The liquid discharging device (e.g., the image forming device 202) and the image forming apparatus (e.g., the image forming apparatus 200), which include the liquid discharging head (e.g., the recording heads 211K, 211C, 211M, and 211Y) according to the above-described exemplary embodiments, may be applied to or may include an image forming apparatus having one of copying, printing, plotter, and facsimile functions, an image forming apparatus (e.g., a multifunction printer) having at least one of copying, printing, plotter, and facsimile functions, or the like. The above-described exemplary embodiments may be applied to an image forming apparatus using recording liquid other than ink, fixing liquid, and/or the like and to a liquid discharging device for discharging various liquids.

According to the above-described exemplary embodiments, the image forming apparatus includes an apparatus for forming an image by discharging liquid. A recording medium, on which the image forming apparatus forms an image, includes paper, strings, fiber, cloth, leather, metal, plastic, glass, wood, ceramics, and/or the like. An image formed by the image forming apparatus includes a character, a letter, graphics, a pattern, and/or the like. Liquid, with which the image forming apparatus forms an image, is not limited to ink but includes any fluid and any substance which becomes fluid when discharged from the liquid discharging head. The liquid discharging head may discharge liquid not forming an image as well as liquid forming an image. The liquid discharging device is not limited to a device for forming an image, but includes any device for discharging liquid.

Numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

This patent specification is based on Japanese Patent Application No. 2007-170803 filed on Jun. 28, 2007 in the Japan Patent Office, the entire contents of which are hereby incorporated herein by reference.

What is claimed is:

1. A liquid discharging head for discharging a liquid drop from a nozzle connected to a liquid chamber including a wall formed of a vibration plate, the liquid discharging head comprising:

a piezoelectric actuator configured to displace the vibration plate to cause the nozzle to discharge the liquid drop from the liquid chamber, the piezoelectric actuator comprising:

at least three driven piezoelectric elements aligned in a line, each driven piezoelectric element of the at least three driven piezoelectric elements comprising:

a plurality of piezoelectric element columns aligned in a direction in which the at least three driven piezoelectric elements are aligned; and a groove provided between adjacent piezoelectric element columns, wherein a pitch between adjacent piezoelectric element columns that are within any one of the at least three driven piezoelectric elements is different from a pitch between adjacent piezoelectric element columns that are within another one of the at least three driven piezoelectric elements.

2. The liquid discharging head according to claim 1, wherein the pitch between adjacent piezoelectric element columns in any one piezoelectric element is uniform.

3. The liquid discharging head according to claim 1, wherein the pitch between adjacent piezoelectric element columns in any one piezoelectric element varies.

4. The liquid discharging head according to claim 1, further comprising:

a clearance provided between adjacent piezoelectric elements, wherein a center of the clearance corresponds to a center of the groove formed in the clearance.

5. The liquid discharging head according to claim 4, further comprising:

a first row of piezoelectric elements formed by the at least three piezoelectric elements aligned in a first line; and at least one other row of piezoelectric elements formed by another at least three piezoelectric elements aligned in a second line different from but parallel to the first line, wherein the clearances in the first row of piezoelectric elements are provided in correspondence with the clearances in the at least one other row of the piezoelectric elements, and wherein the groove is formed in the clearance by a plurality of processing steps.

6. The liquid discharging head according to claim 1, wherein for each driven piezoelectric element of the at least three driven piezoelectric elements, the plurality of piezoelectric element columns of the driven piezoelectric element includes one or more driven columns and one or more non-driven columns, the driven columns and non-driven columns being arranged alternately.

7. The liquid discharging head according to claim 1, wherein each driven piezoelectric element of the at least three driven piezoelectric elements includes one or more driven columns.

8. A liquid discharging head for discharging a liquid drop from a nozzle connected to a liquid chamber including a wall formed of a vibration plate, the liquid discharging head comprising:

a piezoelectric actuator configured to displace the vibration plate to cause the nozzle to discharge the liquid drop from the liquid chamber, the piezoelectric actuator comprising:

at least two parallel rows of piezoelectric elements including a first row and a second row; and a clearance provided between adjacent piezoelectric elements in a direction in which the row extends, each of the at least two rows comprising:

at least three piezoelectric elements aligned in a line, each of the at least three piezoelectric elements comprising:

a plurality of piezoelectric element columns aligned in a direction in which the at least three piezoelectric elements are aligned; and a groove provided between adjacent piezoelectric element columns in each piezoelectric element of the at least three piezoelectric elements, wherein the clearances in the first row are staggered with respect to the clearances in the adjacent second row in the direction in which the first and second rows extend, and wherein, in a single piezoelectric element, a first area between the clearance facing one end of the piezoelectric element in the first row and a position corresponding to the clearance in the second row has a pitch of the piezoelectric element columns different from a pitch of the piezoelectric element columns in a second area between the clearance facing another end of the piezoelectric element in the first row and the position corresponding to the clearance in the second row.

9. The liquid discharging head according to claim 8, wherein a center of the clearance in the first row of the piezoelectric elements corresponds to a center of the groove in the second row of the piezoelectric elements in the direction in which the first and second rows extend.

10. An image forming apparatus for forming an image, comprising:

a liquid discharging head configured to discharge a liquid drop from a nozzle connected to a liquid chamber, the liquid discharging head comprising:

a piezoelectric actuator configured to cause the nozzle to discharge the liquid drop from the liquid chamber, the piezoelectric actuator comprising:

at least three driven piezoelectric elements aligned in a line, each driven piezoelectric element of the at least three driven piezoelectric elements comprising:

a plurality of piezoelectric element columns aligned in a direction in which the at least three driven piezoelectric elements are aligned; and a groove provided between adjacent piezoelectric element columns, wherein a pitch between adjacent piezoelectric element columns that are within any one of the at least three driven piezoelectric elements is different from a pitch between adjacent piezoelectric element columns that are within another one of the at least three driven piezoelectric elements.

11. A liquid discharging head for discharging a liquid drop from a nozzle connected to a liquid chamber, the liquid discharging head comprising:

a piezoelectric actuator configured to cause the nozzle to discharge the liquid drop from the liquid chamber, the piezoelectric actuator comprising:

at least three driven piezoelectric elements aligned in a line, each driven piezoelectric element of the at least three driven piezoelectric elements comprising:

a plurality of piezoelectric element columns aligned in a direction in which the at least three driven piezoelectric elements are aligned; and a groove provided between adjacent piezoelectric element columns, wherein a pitch between adjacent piezoelectric element columns that are within any one of the at least three driven piezoelectric elements is different from a pitch between adjacent piezoelectric element columns that are within another one of the at least three driven piezoelectric elements.

* * * * *